US010470574B2

(12) United States Patent
Schneider

(10) Patent No.: US 10,470,574 B2
(45) Date of Patent: Nov. 12, 2019

(54) CHAIR HAVING SYNCHRONIZED BACKREST AND SEAT MOVEMENTS

(71) Applicant: STEELCASE INC., Grand Rapids, MI (US)

(72) Inventor: Jean-Marc Schneider, Sarrebourg (FR)

(73) Assignee: STEELCASE INC., Grand Rapids, MI (US)

( * ) Notice: Subject to any disclaimer, the term of this patent is extended or adjusted under 35 U.S.C. 154(b) by 608 days.

(21) Appl. No.: 15/150,934

(22) Filed: May 10, 2016

(65) Prior Publication Data

US 2016/0249739 A1 Sep. 1, 2016

Related U.S. Application Data

(63) Continuation of application No. PCT/FR2013/052763, filed on Nov. 18, 2013.

(51) Int. Cl.

| | |
|---|---|
| ***A47C 1/032*** | (2006.01) |
| ***A47C 3/025*** | (2006.01) |
| ***A47C 7/44*** | (2006.01) |
| ***A47C 1/033*** | (2006.01) |

(52) U.S. Cl.

CPC ..... *A47C 1/03261* (2013.01); *A47C 1/033* (2013.01); *A47C 1/03277* (2013.01); *A47C 3/025* (2013.01); *A47C 7/44* (2013.01); *A47C 7/445* (2013.01)

(58) Field of Classification Search

CPC . A47C 1/03261; A47C 1/03277; A47C 1/033; A47C 3/025; A47C 7/44; A47C 7/445

USPC ..... 297/297, 298, 316

See application file for complete search history.

(56) References Cited

U.S. PATENT DOCUMENTS

| | | | | |
|---|---|---|---|---|
| 4,789,203 | A | 12/1988 | van Zee et al. | |
| 6,511,128 | B2 | 1/2003 | Piretti | |
| 6,896,328 | B2 | 5/2005 | Goodworth | |
| 8,272,692 | B1 * | 9/2012 | Epperson | A47C 1/03272 297/296 |
| 2006/0290182 | A1 * | 12/2006 | Moreschi | A47C 1/03233 297/316 |
| 2009/0236890 | A1 * | 9/2009 | Kan | A47C 3/021 297/297 |

FOREIGN PATENT DOCUMENTS

| | | |
|---|---|---|
| WO | WO 97/03590 | 2/1997 |
| WO | WO 2010/086187 A1 | 8/2010 |

OTHER PUBLICATIONS

International Search Report in International Application No. PCT/FR2013/052763, dated Jul. 25, 2014, 6 pages.

* cited by examiner

*Primary Examiner* — Anthony D Barfield

(74) *Attorney, Agent, or Firm* — Brinks Gilson & Lione

(57) ABSTRACT

A chair includes a seat and a backrest connected to a leg assembly. The front part of the seat is mounted on the leg assembly via a pivot link about an axis. The backrest is connected to the seat by a flexible intermediate part fixed to the leg assembly in the vicinity of the pivot of the seat for the purpose of a pivoting movement of the intermediate part by elastic deformation about an axis. The rear part of the seat is supported by the intermediate part, for example with at least one coupling element.

23 Claims, 2 Drawing Sheets

CHAIR HAVING SYNCHRONIZED BACKREST AND SEAT MOVEMENTS

This application is a continuation of International Application PCT/FR2013/052763, filed Nov. 18, 2013, and entitled Office Chair Having Synchronized Backrest And Seat Movements, the entire disclosure of which is hereby incorporated herein by reference.

FIELD OF THE INVENTION

The present application relates to a chair, the structure of which responds in dynamic fashion to the leaning of a user against the backrest of the chair. In one embodiment, the chair is provided with a mechanism enabling simultaneous adjustment of the tilt of the backrest and of the seat by several degrees when a user leans against the backrest.

This mechanism will be described with reference to office chairs, for example where users work at computers. However, the mechanism is applicable to any other kind of chair.

BACKGROUND

Office chairs have developed considerably, from simple chairs to sophisticated ones in which the user can change the height of the seat, the degree of tilting of the backrest, the pivoting of the armrests, etc. Although chairs with synchronized backrest and seat movements already exist, their synchronization mechanisms are relatively complex and bulky, leading to higher costs and lack of aesthetics.

SUMMARY

A mechanism permits the user to tilt both the backrest and the seat easily when he leans against the chair in such a way that his entire body and not just his back is inclined, this being brought about by means of a device that has a minimum of components, is easily implemented, and does not require any specific control means such as a button, lever, handle, etc.

In one embodiment, the chair includes, in standard fashion, a seat and a backrest of essentially perpendicular appearance and connected to a leg assembly.

This chair includes a front part of the seat distal with respect to a backrest, with the front part being mounted on the leg assembly via a pivot link about an axis of parallel appearance to the intersection of the planes of the backrest and of the seat. The backrest is connected to the seat by means of a flexible intermediate part having a portion of parallel appearance to the seat and fixed to the leg assembly in the vicinity of the pivot link of the seat for the purpose of a pivoting movement of the intermediate part by elastic deformation about an axis in the vicinity of and parallel to the pivot axis of the seat. The rear part of the seat proximal with respect to the backrest rests on the intermediate part by means of at least one coupling element of vertical appearance, the upper end of which is fixed to the seat and the lower end of which rests on the intermediate part.

The mechanism provides for synchronizing the movements of the seat and the backrest. Thus, for example, the rearward tilting of the backrest resulting from a pressing force exerted by the user brings about, by synchronization, a clockwise pivoting of the seat with a downward tilting of the rear part of the seat.

This synchronization is achieved via the flexible intermediate part, which has a first portion fixed to the rear of the backrest, the second portion of the flexible intermediate part being of parallel appearance to the seat and fixed to the leg assembly and connected to the underside of the seat, the angle formed between the first portion and the second portion being capable of varying according to the pressing force exerted by a user on the backrest. This flexible intermediate part thus connects the backrest directly to the seat.

Hence when the user leans against the backrest, the first portion will tend to tilt backwards while the second portion will tend to tilt downwards. This double tilting affords the user better seating and support in his chair and since the pelvis follows the movement of the back, curvature of the lower back while tilting the backrest is avoided. Also, the flexibility of the intermediate part allows a tilting of the seat that is adapted to the weight of the user. Since the entire synchronized tilting is based on the flexibility of the intermediate part, no additional adjustment mechanism is needed; the user only needs to control the pressing force that he exerts on the backrest in order to tilt the backrest and the seat to a greater or lesser degree.

According to a first configuration and embodiment, the flexible intermediate part includes at least one flexible L-shaped strip, the two arms of which respectively correspond to two portions. More precisely, the free end of the first portion is fixed to the rear of the backrest, the free end of the second portion is fixed to a cross member belonging to the leg assembly, and the middle part of the second portion is connected to the rear part of the seat via two coupling pads.

In a variant, this flexible intermediate part consists of a single median flexible strip disposed in the vertical midplane of the chair, whereas in another variant, this intermediate part consists of two lateral flexible strips disposed on both sides of the vertical midplane of the chair.

The choice of the material for the strips, the number of strips and the positions thereof in relation to the backrest makes it possible to obtain various ranges of chairs allowing for synchronized backrest and seat movements that respond to different needs, according to the intended use of the chair. For example, medical chairs could allow for greater tilting than airplane or train seats, which in turn could allow for greater tilting than office chairs.

According to a second configuration and embodiment, the first portion of the flexible intermediate part consists of a U-shaped frame that frames the lower part of the backrest, and the second portion consists of a plate extending under the seat, the front end of which is fixed to a cross member belonging to the leg assembly and the middle part of which is connected to the rear part of the seat via two coupling pads. The frame has means of fixation to the plate, which includes a fastening tab of horizontal appearance that is superimposed on the rear end of the plate, the fixation being achieved by screwing, for example. This configuration makes it possible to have the entire rear of the backrest free, thus lending refined aesthetics to the chair.

According to a third configuration and embodiment, the first portion of the flexible intermediate part includes a bar of rounded appearance that winds around the rear of the backrest, passes over lateral rods belonging to the leg assembly, and joins to the second portion consisting of a plate that extends under the seat, wherein the front end of said plate is fixed to a cross member belonging to the leg assembly, a clearance is provided between the bar and the lateral rods to allow the seat to pivot, and the lateral rods act as a stop for restricting the pivoting of the seat.

In a general fashion and regardless of the chosen configuration, a stop restricts the pivoting of the seat. This prevents damage to the intermediate part due to undesired plastic deformation, the tilting being limited to elastic deformation.

Furthermore, the pivot link between the seat and the leg assembly may be achieved by means of a linchpin or flexible mountings or ball joints.

Additionally, the flexible intermediate part is attached to the backrest and to the leg assembly with a screw-nut fixation means. This is thus a rigid fixation, the tilting being effected solely by the elastic deformation of the intermediate part.

BRIEF DESCRIPTION OF THE DRAWINGS

The embodiments will now be described in more detail, with reference to the appended figures, wherein.

DETAILED DESCRIPTION OF THE PRESENTLY PREFERRED EMBODIMENTS

Figure 1:
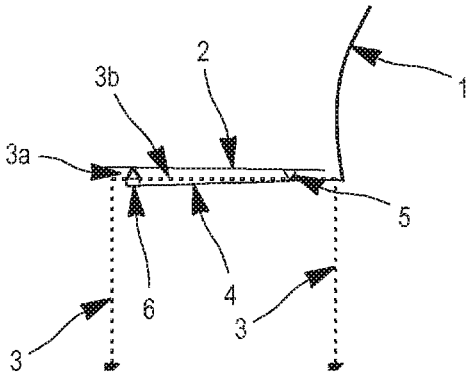
FIGS. 1 and 2 are schematic views of the chair, in the nominal position and in an inclined position, respectively.
Figure 2:
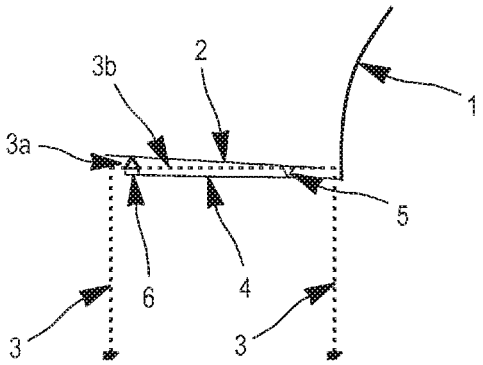

With reference to all of the figures, the chair includes a seat (2), a backrest (1), and a leg assembly or support frame having a front rod (3*a*) connecting the upper ends of two front legs (3) and two lateral rods (3*b*) connecting the upper ends of two right legs (3) and of two left legs (3), respectively. There may or may not be a rear rod connecting the two rear legs (3).

The seat (2) is pivotally fixed to the support frame on the front rod (3*a*). This pivot link is achieved by means of a linchpin or flexible mountings or ball joints. The back part of the seat (2) is able to pivot in the free space delimited between the upper ends of the two rear legs (3).

The seat (2) is connected to the backrest (1) via a flexible intermediate part (4) capable of deformation in order to synchronize the rearward tilting movement of the backrest (1) with a proportional rearward tilting movement of the seat (2).

The intermediate part (4) and the backrest (1) are mechanically linked by a rigid fixation, preferably of the screw-nut type.

This intermediate part (4) is furthermore fixed to the front of the support frame on a cross member (6), which is parallel to the front rod (3*a*). The fixation is rigid and achieved by screwing. The intermediate part (4) is also connected to the rear part of the seat (2) via coupling pads (5) of vertical appearance, the upper end of which is fixed under the seat (2) and the lower end of which rests on the intermediate part (4). This contact allows the seat (2) to follow the deformation movement of the intermediate part (4) according to the weight of the user.

Figure 3:
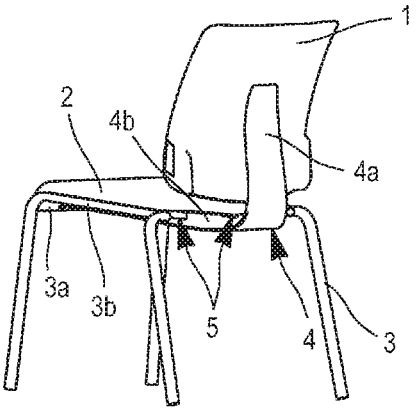
FIGS. 3 and 4 represent a first embodiment of the chair, with a first variant having a single flexible strip and a second variant having two flexible strips.

According to the embodiment shown in FIG. 3, the intermediate part (4) consists of an L-shaped flexible strip, whose one arm (4*b*) of horizontal appearance is fixed to the support frame on the cross member (6) and connected to the seat (2) as described above, and whose other arm (4*a*) of vertical appearance extends to the rear of the backrest (1) and is rigidly fixed thereon.

The rearward tilting of the backrest (1) thus effects a rearward bending of the vertical arm (4*a*) of the strip (4) in combination with a variation of the angle between the two arms (4*a*, 4*b*) of the strip (4) and a downward bending of the horizontal arm (4*b*) of the strip (4), the seat (2) resting on the strip (4) tilting downward by the same amount. All of these movements of the backrest (1), of the strip (4), and of the seat (2) vary according to the initial force exerted by the user on the backrest (1) of the chair when he leans against it. This force likewise depends on the weight of the user.

Figure 4:
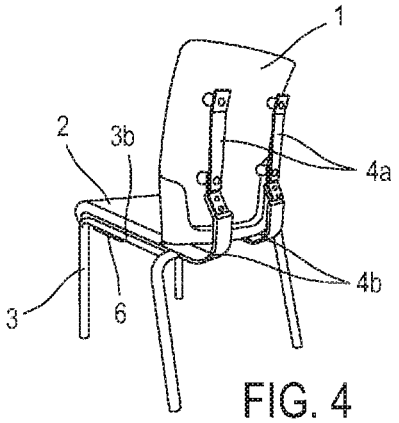

In FIG. 4, the median flexible strip (4) is replaced with two lateral flexible strips (4) disposed on both sides of the vertical midplane of the backrest. The fixation of the strips (4) to the chair and the principle behind the synchronization of the movements between the backrest (1) and the seat (2) are identical to those of the single strip (4) variant.

Figure 5:
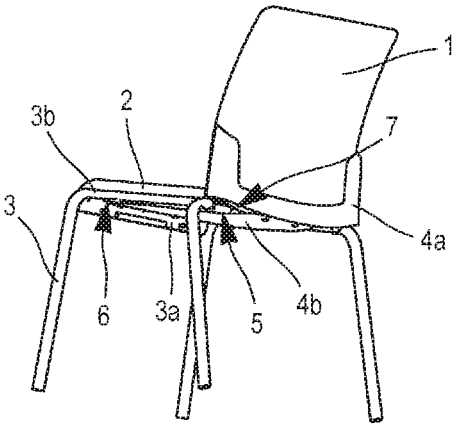
FIG. 5 shows a second embodiment of the chair.
Figure 6:
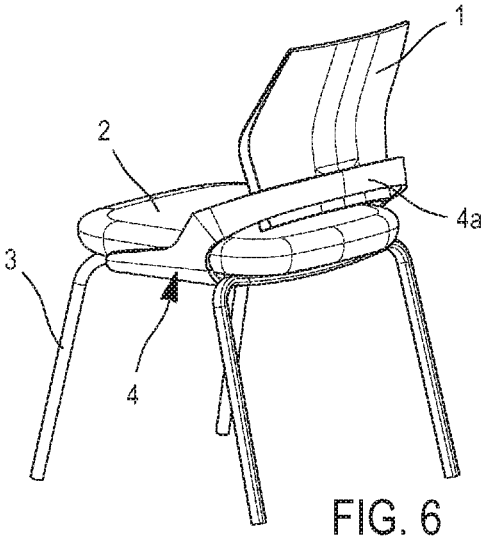
FIGS. 6 through 10 illustrate a third embodiment of the chair.
Figure 7:
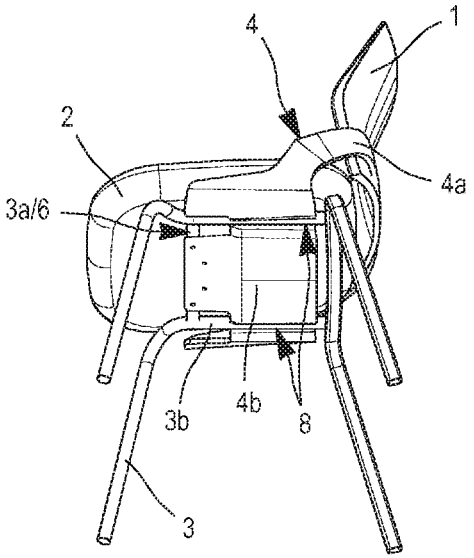
Figure 8:
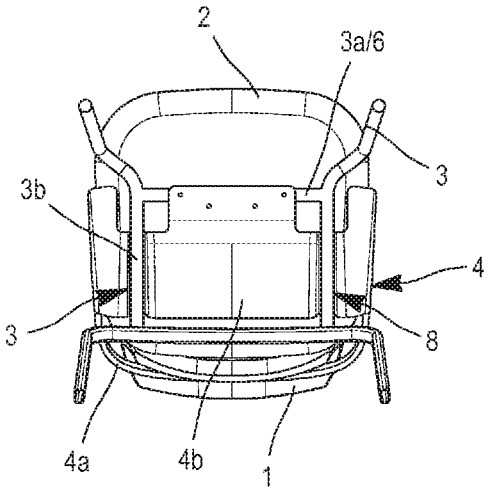
Figure 9:
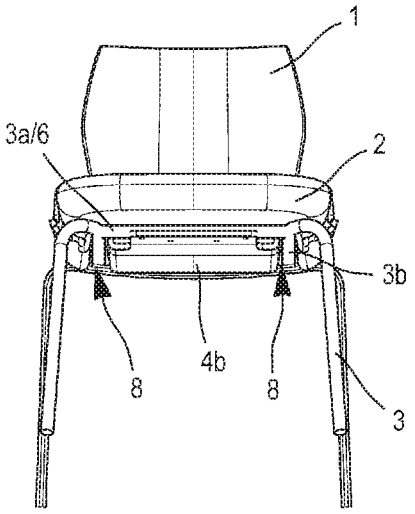
Figure 10:
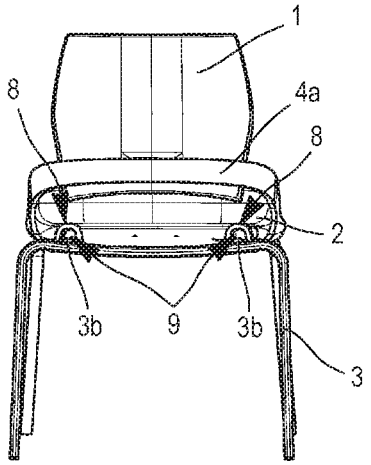

In FIG. 5, the intermediate part includes a plate (4*b*) of horizontal appearance fixed to the front cross member (6) belonging to the support frame and connected to the seat (2) via two coupling pads (5) and a U-shaped frame (4*a*) surrounding the lower part of the backrest (1) and comprising a fixation tab (7) of horizontal appearance capable of being superimposed on the rear end of the plate (4*b*) and of being fixed thereon by screwing, for example.

In this case, the two lateral arms of the frame (4*a*) follow the tilting movement of the backrest (1), and the angle between the frame (4*a*) and the plate (4*b*) varies by virtue of their respective flexibilities. The tab (7) operates in torsion during the tilting of the backrest (1) and thus allows the plate (4*b*) to bow downward so that the seat (2) pivots clockwise.

In the embodiment shown in FIGS. 6 through 10, the flexible part (4) has a special shape that surrounds the rear of the backrest (1). Specifically, the intermediate part (4) consists of a bar (4*a*) of rounded appearance that winds around the rear of the backrest (1) and passes over the sides of the chair, fits in between the lateral rods (3*b*) and the seat (2) and then prolongs into a plate (4*b*) extending under the seat. This plate (4*b*) is fixed onto the front cross member (6) of the support frame and is connected to the seat (2) via two coupling pads (5) that are not visible in these figures.

The bar (4*a*) is equipped with two grooves (8) into which the lateral rods (3*b*) are inserted, with provision being made for a free space (9) between the bottom of each groove (8) and the corresponding lateral rod (3*b*) to allow a clearance between the bar (4*a*) and the support frame. In the position of maximum tilting, the bottom of the grooves comes in abutment with the lateral rods (3*b*), thus restricting the pivoting of the seat (2).

In a general fashion and regardless of the chosen configuration, a stop can be implemented in the chair in order to restrict the pivoting of the seat (2) and to prevent plastic deformation of the various components.

The embodiments shown in the aforementioned figures are merely possible examples of the invention, which is not in any way limited by them and which on the contrary encompasses the form and design variants available to the person skilled in the art.

The invention claimed is:

1. A chair comprising:

a seat and a backrest pivotally connected to a leg assembly, wherein a front part of the seat distal with respect to the backrest is pivotally mounted on the leg assembly about a first pivot axis; and wherein the backrest is connected to the leg assembly with a flexible intermediate part extending under the seat, wherein the intermediate part is fixed to the leg assembly for the purpose of a pivoting movement of the intermediate part by elastic deformation of the intermediate part about a second pivot axis parallel to the first pivot axis of the seat; and at least one coupling element disposed between and engaged with a rear part of the seat proximal with respect to the backrest and the intermediate part.

2. The chair according to claim 1 wherein an upper end of the at least one coupling element is fixed to the seat and a lower end of the at least one coupling element rests on the intermediate part.

3. The chair according to claim 1 wherein the flexible intermediate part has a first portion fixed to a rear of the backrest and a second portion extending under the seat, the angle formed between the first portion and the second portion being capable of varying according to the pressing force exerted on the backrest by a user.

4. The chair according to claim 3 wherein the flexible intermediate part comprises at least one L-shaped flexible strip having two arms defining respectively the first and second portions.

5. The chair according to claim 3 wherein a free end of the first portion is fixed to the rear of the backrest, a free end of the second portion is fixed to a cross member belonging to the leg assembly, and a middle part of the second portion is connected to the rear part of the seat with the at least one coupling element.

6. The chair according to claim 3 wherein the flexible intermediate part comprises a single median flexible strip disposed in a vertical midplane of the chair.

7. The chair according to claim 3 wherein the flexible intermediate part comprises two lateral flexible strips disposed on both sides of a vertical midplane of the chair.

8. The chair according to claim 3, wherein the first portion of the flexible intermediate part comprises a U-shaped frame framing a lower part of the backrest, and the second portion comprises a plate extending under the seat and coupled to the U-shaped frame, wherein a front end of the plate is fixed to a cross member belonging to the leg assembly and wherein the coupling element is disposed between a middle part of the plate and the rear part of the seat.

9. The chair according to claim 8 wherein the U-shaped frame is coupled to the plate with a fixation tab.

10. The chair according to claim 3 wherein the first portion of the flexible intermediate part comprises a bar of rounded appearance that winds around the rear of the backrest, overlies the frame and joins to the second portion comprising a plate extending under the seat, wherein a front end of the plate is fixed to a cross member belonging to the leg assembly, and wherein a clearance is provided between the first portion and the frame to allow the seat to pivot, with the frame acting as a stop for restricting the pivoting of the seat.

11. The chair according to claim 1 wherein a stop restricts the pivoting of the seat.

12. The chair according to claim 1 wherein the seat is pivotally connected to the leg assembly with a linchpin, flexible mounting, or ball joint.

13. The chair according to claim 1 wherein the flexible intermediate part is attached to the backrest and to the leg assembly with a mechanical fastener.

14. The chair according to claim 1 wherein the intermediate part has a front portion non-pivotally fixed to the leg assembly.

15. A chair comprising:

a frame;

a seat comprising a front portion pivotally connected to the frame about a first pivot axis and a rear portion spaced rearwardly from the front portion;

a flexible intermediate part underlying the seat and fixedly connected to the frame, wherein the rear portion of the seat is supported by the intermediate part, wherein the intermediate part is elastically deformable from a nominal position to a deformed position, and wherein the seat is moveable from an at rest position to a rear tilt position as the intermediate part is deformed from the nominal position to the deformed position; and a backrest connected to the intermediate part.

16. The chair according to claim 15 wherein the intermediate part comprises an upright portion coupled to the backrest and a flexible portion underlying the seat and fixedly connected to the seat, wherein the upright portion and the flexible portion are angularly moveable relative to each other.

17. The chair according to claim 15 further comprising a coupling element disposed between the rear portion of the seat and the intermediate part.

18. The chair according to claim 15 wherein the flexible intermediate part comprises a single flexible strip disposed in a vertical midplane of the chair.

19. The chair according to claim 15 wherein the flexible intermediate part comprises two lateral flexible strips disposed on both sides of a vertical midplane of the chair.

20. The chair according to claim 16 wherein the upright portion of the flexible intermediate part comprises a U-shaped frame framing a lower part of the backrest, and the flexible portion comprises a plate extending under the seat and coupled to the U-shaped frame, wherein a front end of the plate is fixed to a cross member belonging to the frame.

21. The chair according to claim 16 wherein the upright portion of the flexible intermediate part comprises a curved bar that encircles the backrest.

22. The chair according to claim 15 wherein a stop restricts the pivoting of the seat in the rear tilt position.

23. The chair according to claim 15 wherein the intermediate part has a front portion non-pivotally fixed to the frame.

* * * * *